US006892708B2

(12) United States Patent
Nasu

(10) Patent No.: US 6,892,708 B2
(45) Date of Patent: May 17, 2005

(54) FUEL INJECTION SYSTEM AND CONTROL METHOD

(75) Inventor: Fumiaki Nasu, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/641,002

(22) Filed: Aug. 15, 2003

(65) Prior Publication Data

US 2004/0040545 A1 Mar. 4, 2004

(30) Foreign Application Priority Data

Sep. 3, 2002 (JP) ..... 2002-257244

(51) Int. Cl.[7] ..... F02M 51/00
(52) U.S. Cl. ..... 123/490
(58) Field of Search ..... 123/490, 494; 361/152, 154

(56) References Cited

U.S. PATENT DOCUMENTS 6,234,150 B1 * 5/2001 Watanabe ..... 123/490
6,332,455 B1 * 12/2001 Sumida et al. ..... 123/490
6,453,876 B1 * 9/2002 Fukutomi et al. ..... 123/490
6,532,940 B1 * 3/2003 Ono et al. ..... 123/490
6,684,862 B2 * 2/2004 Oyama et al. ..... 123/490

FOREIGN PATENT DOCUMENTS

JP 06-241137 8/1994

* cited by examiner

*Primary Examiner*—Hai Huynh
(74) *Attorney, Agent, or Firm*—Crowell & Moring LLP

(57) ABSTRACT

A fuel injection valve driving method includes control of an overexciting current and a holding current supplied to the fuel injection valve in accordance with a target fuel supply pressure as obtained from an operating condition. Thereby the opening and holding of the open position of the fuel injection valve is controlled.

15 Claims, 9 Drawing Sheets

FUEL INJECTION SYSTEM AND CONTROL METHOD

BACKGROUND OF THE INVENTION

The present invention relates to a fuel injection system and a fuel injection valve driving method.

An overexciting current and a holding current for driving a fuel injection valve have conventionally been set to fixed values. Because of a need for a reduction in exhaust emissions, however, there are now requirements for expanding a dynamic range of fuel injection amount control and for an extremely small amount of fuel injection. To meet these requirements, there is known a method as disclosed, for example, in Japanese Patent Laid-open No. Hei 6-241137, in which the overexciting current and the holding current supplied to the fuel injection valve are varied in accordance with a fuel supply pressure detected by a fuel supply pressure detector.

The fuel injection valve driving method by means of the fuel supply pressure detector, however, involves various types of delay including a response lag of the fuel supply pressure detector, a lag produced by a noise filter of a signal processing circuit, and a lag produced by a software filter provided in an arithmetic unit. More specifically, because of these delay factors involved, a lag is generated in detection of the fuel supply pressure despite the fact that the fuel supply pressure is, in reality, already high. As a result, a lag is produced in increasing the value of current supplied to the fuel injection valve. Then, no attractive force for overcoming the fuel supply pressure is generated in the fuel injection valve. That is, a condition arises, in which fuel is not injected because of the fuel injection valve not being opened.

SUMMARY OF THE INVENTION

It is therefore an object of the present invention to provide a system that properly opens a fuel injection valve while keeping minimum a detection lag of fuel supply pressure and a method thereof.

To achieve the foregoing object, an arrangement is provided according to preferred embodiments of the present invention to control a fuel pressurizing unit so that a target fuel supply pressure as calculated from an engine operating condition becomes a supply pressure of the fuel. The arrangement is characterized by a fuel injection valve that opens when an overexciting current is supplied thereto and that keeps the open position when a holding current is supplied thereto. The arrangement is further characterized in that fuel is supplied to the fuel injection valve by varying the overexciting current and the holding current in accordance with the target fuel supply pressure.

DESCRIPTION OF THE PREFERRED EMBODIMENTS

Figure 1:
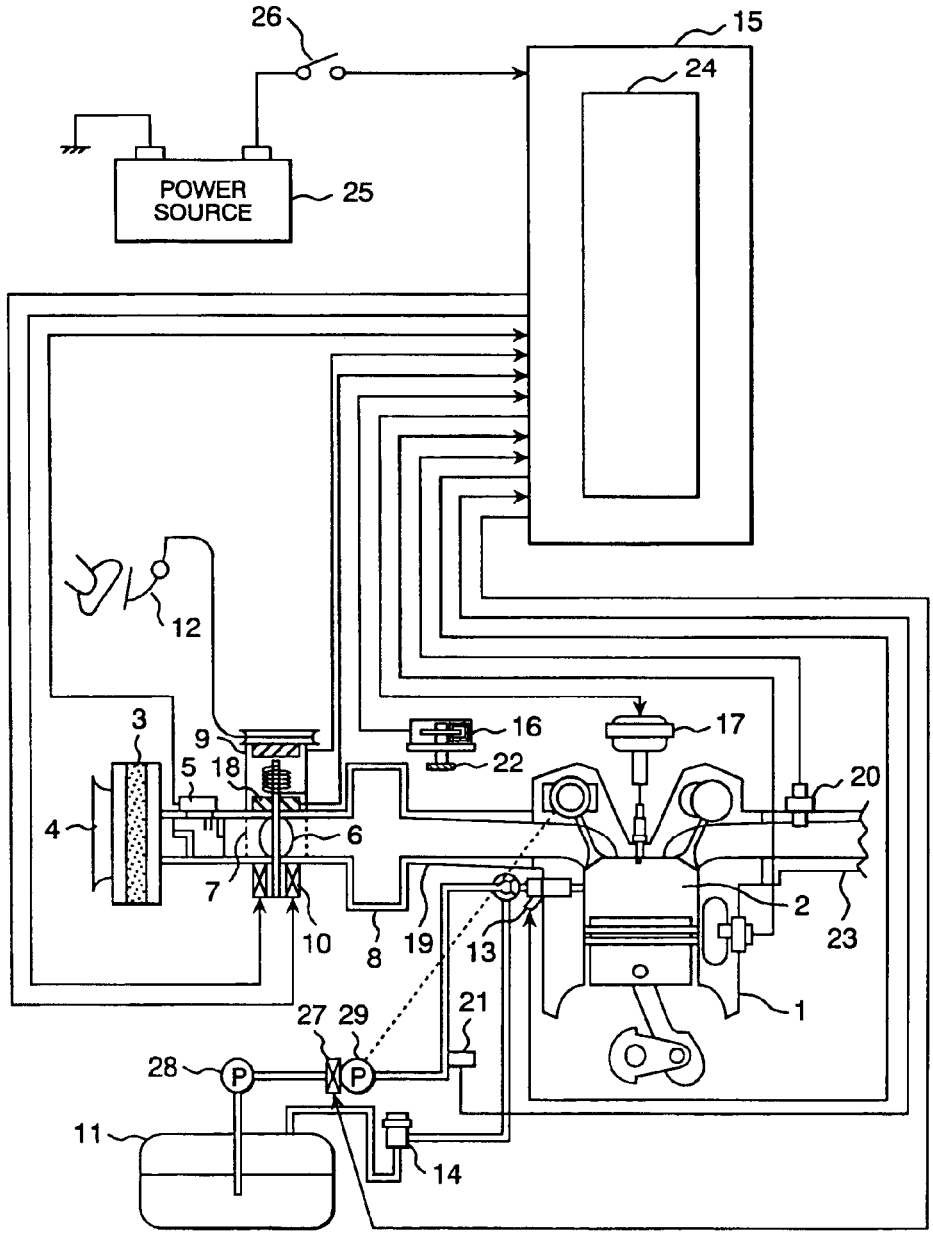
FIG. 1 is a diagram showing a system configuration according to the present invention.

Preferred embodiments of the present invention will be explained with reference to the accompanying drawings.

A feature of the present invention does not lie in a mode of controlling an overexciting current and a holding current supplied to a fuel injection valve in accordance with a detected supply pressure of the fuel supplied. In contrast, one of the characteristics of the present invention lies in a mode in which, to control a fuel control unit so as to bring a target fuel supply pressure calculated based on operating conditions of an engine to a fuel supply pressure, the overexciting current for opening a fuel injection valve and the holding current for keeping its open position, which are supplied to the fuel injection valve, are varied in accordance with the target fuel supply pressure, and thus, fuel is supplied to the fuel injection valve for injection.

To achieve the foregoing, the arrangement according to the present invention is provided with the following components. The components include: a fuel pressurizing unit (a flow control valve 27 and a high-pressure fuel pump 29) that pressurizes fuel; a fuel supply pressure monitoring unit (a fuel pressure sensor 21) that detects a supply pressure of the fuel; an operating condition detecting unit (an accelerator sensor 9 and a crank angle sensor 16) that detects an operating condition of an engine; a control device (a control unit 15) that calculates a target fuel supply pressure based on the detected operating condition and controls the fuel pressurizing unit so as to bring the supply pressure to the target fuel supply pressure; and a fuel injection valve 13 that opens when an overexciting current is supplied thereto and keeps the open position while a holding current is supplied thereto. An overexciting current 33*a* and a holding current 34*a* supplied to the fuel injection valve are varied according to the target fuel supply pressure, thereby ensuring that fuel, the pressure of which has been controlled to the target fuel supply pressure, is supplied to and injected through the fuel injection valve.

FIG. 1 shows a system configuration according to the present invention. Air to be sucked in by an engine 1 is taken in through an intake 4 of an air cleaner 3 and passes through a throttle valve device 7 equipped with a throttle valve 6 to control the amount of intake air. The air then flows into a collector 8. The throttle valve 6, which is coupled with a motor 10 through a reduction gear, is operated by driving the motor 10. Operating the throttle valve 6 controls the amount of intake air. The intake air in the collector 8 is distributed to each intake air pipe 19 connected to each cylinder 2 of the engine 1, thus being introduced into the cylinder 2.

Gasoline or other fuel is sucked in from a fuel tank 11 and pressurized by a low-pressure fuel pump 28. A high-pressure fuel pump 29 mounted on a camshaft and a flow control valve 27 for controlling the amount of fuel supplied thereto work together to pressurize the fuel to a high pressure. In order to prevent excessive pressurization of fuel, a return valve 14 is also provided to return a part of fuel to the fuel tank if the fuel is pressurized higher than a predetermined level. The pressure of fuel supplied to the fuel injection valve 13 is controlled to any desired value by using a signal detected with a fuel pressure sensor 21 located between the high-pressure fuel pump 29 and the fuel injection valve 13, and the flow control valve 27 controlled by the control unit 15. Thus the fuel with which the pressure is controlled is injected through the fuel injection valve 13 opening the fuel injection port to each cylinder 2. An air flow meter 5 outputs a signal indicating the amount of intake air. This signal is supplied to the control unit 15. Based on the signal, the control unit 15 controls the fuel injection valve to inject the fuel matched the amount of intake air.

The throttle valve device 7 is equipped with a throttle sensor 18 that detects the opening of the throttle valve 6. The output of the throttle sensor 18 is also supplied to the control unit 15.

A crank angle sensor 16 is driven with the revolution of a camshaft 22 and outputs a signal indicating the rotating position of a crankshaft. This signal is also supplied to the control unit 15.

An A/F (air-fuel ratio) sensor 20, mounted on an exhaust pipe 23, detects an actual air-fuel ratio based on components of exhaust emissions and produces a corresponding output signal. This signal is also provided for the control unit 15.

An accelerator sensor 9 provided integrally with the throttle valve device 7 is coupled to an accelerator pedal 12. The accelerator sensor 9 detects the operating amount of the accelerator pedal 12 operated by a driver. The sensor then produces a signal corresponding to the operating amount of the accelerator pedal and supplies the signal to the control unit 15. The control unit 15 is equipped with a processing unit (CPU) 24. Receiving signals from the various sensors for detecting engine operating conditions, including the crank angle signal and the accelerator opening signal, the CPU 24 executes required calculations and provides the fuel injection valve 13, an ignition coil 17, and the motor 10 for operating the throttle valve with required control signals. The CPU thereby executes a fuel supply control, an ignition timing control, and an intake air control.

An ignition switch 26 is located between a power source (battery) 25 and the control unit 15.

Figure 2:
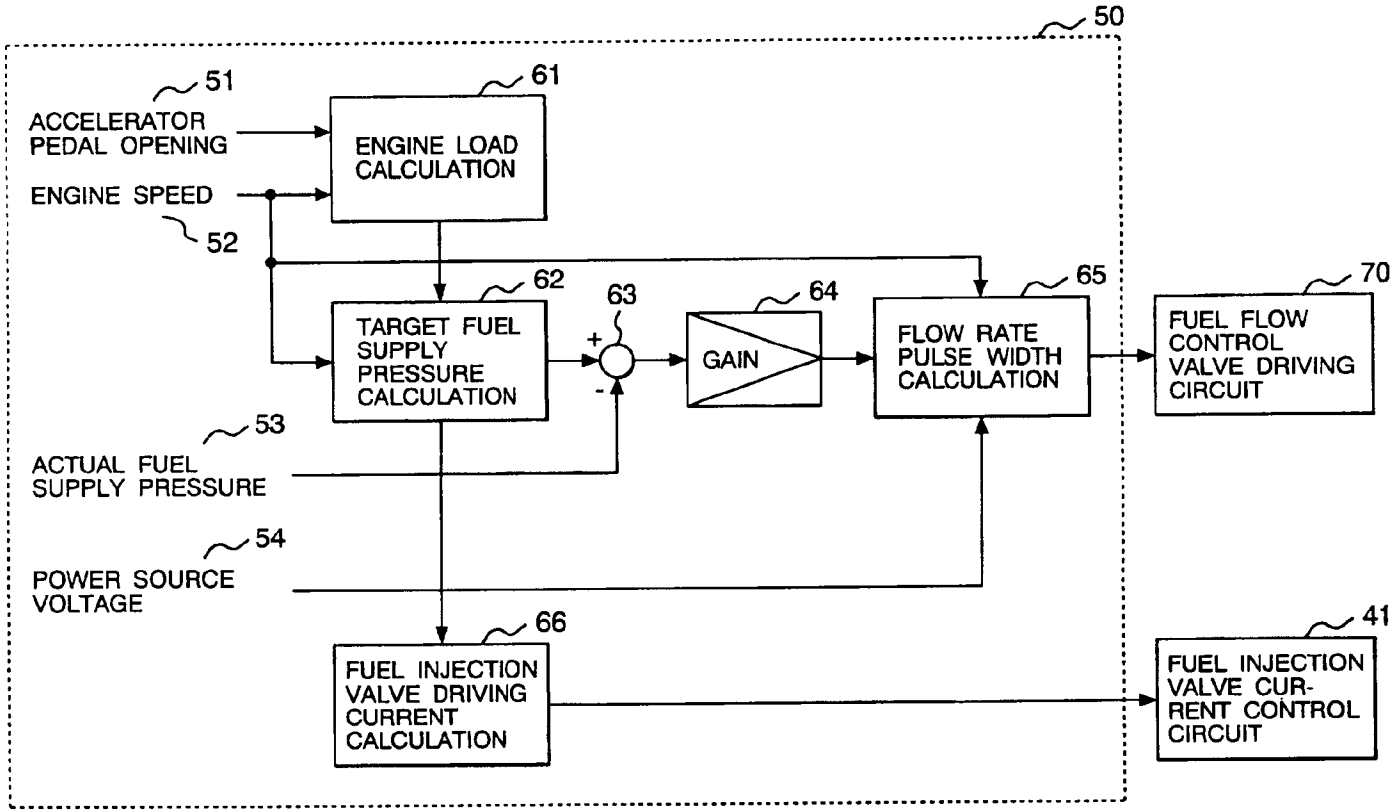
FIG. 2 is a control block diagram showing the present invention.

FIG. 2 shows a control block diagram according to the present invention.

Flow of calculations performed by the control unit 15 or the CPU 24 is shown in a control block 50. An engine load calculation 61 is first performed to find an engine load based on an accelerator pedal opening 51 obtained through the accelerator sensor and an engine speed 52 obtained through the crank angle sensor. Based on the engine load obtained through the foregoing procedure and the engine speed 52, a target fuel supply pressure calculation 62 is performed to obtain a target fuel supply pressure. A comparison 63 is made between an actual fuel supply pressure 53 obtained from the fuel pressure sensor and the target fuel supply pressure. Amplification 64 is then made of a difference between these two values. A fuel flow rate pulse width calculation 65 is then performed to find a flow rate pulse based on the amplified value, the engine speed 52, and a power source voltage 54. The flow rate pulse is next supplied to a fuel flow control valve driving circuit 70 to drive the flow control valve.

Using the target fuel supply pressure obtained through the foregoing procedure, a fuel injection valve driving current calculation 66 is performed to obtain a driving current for the fuel injection valve. Then, the obtained driving current is supplied to a fuel injection valve current control circuit 41 to control the driving current for the fuel injection valve.

Figure 3:
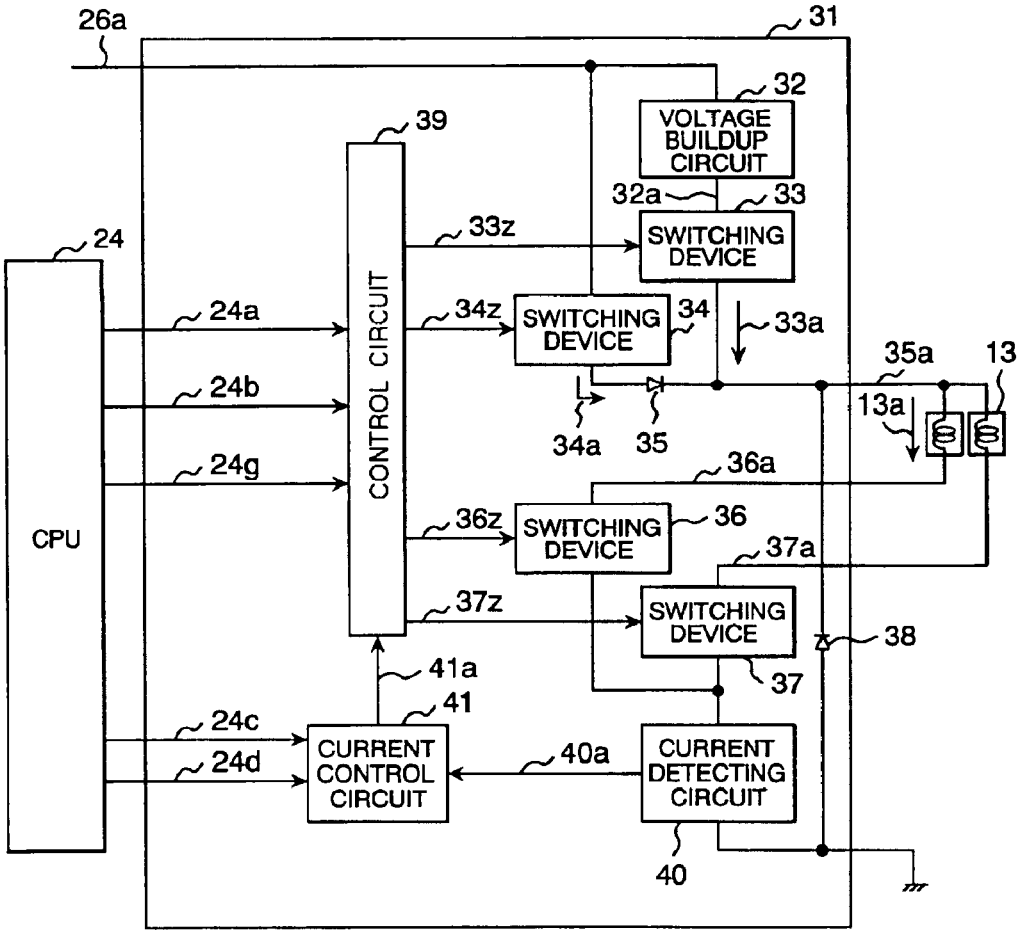
FIG. 3 is a diagram showing a circuit configuration according to the present invention.

FIG. 3 shows a block diagram of a driving circuit for the fuel injection valve 13 in the control unit 15.

A control circuit 31 is for the fuel injection valve 13, being composed of a group of the following circuits. A voltage step-up (booster) circuit 32 is used to create a voltage greater than the battery voltage 26*a*. The fuel injection valve 13 injects fuel directly into the cylinder 2 as described earlier. Because of this, a spring for returning a plunger (movable core with the valve body) in the fuel injection valve 13 is given a powerful tension and the fuel supply pressure is extremely high. As a large magnetic force is therefore required to open the fuel injection valve 13, an ordinary current supply from the battery voltage is unable to open the fuel injection valve 13. Hence, the voltage step-up circuit 32 is needed.

A switching device 33 controls supply and shut-off of the overexciting current 33*a* to the fuel injection valve 13 from a stepped-up voltage 32*a* generated by the voltage step-up circuit 32.

A switching device 34 controls supply and cut-off of the holding current 34*a* for holding the opening of the fuel injection valve 13 from the battery voltage 26*a*. Since the supply current from the switching device 33 and the supply current from the switching device 34 is wired-OR on a signal line 35*a*, there is a voltage relationship of which the stepped-up voltage 32*a* is greater than the battery voltage 26*a* on the signal line 35*a*. Therefore, if any considerations are not made about that, it is possibility that the current from stepped-up voltage 32*a* flows into the battery through the switching devices 33, 34. To prevent the problem, a current reverse flow preventive device 35 is provided between the signal line 35*a* and the switching device 34.

Switching devices 36 and 37 allow current for the fuel injection valve 13 to sink (flow) in a ground direction, each independently provided for each fuel injection valve.

The fuel injection valve 13 is driven by controlling the current supplied thereto. A current detecting circuit 40 for detecting current flowing through the fuel injection valve 13 is therefore provided. The CPU 24 calculates an overexciting current selecting signal 24*c* and a holding current selecting signal 24*d* based on the target fuel supply pressure. A current control circuit 41 compares a current value signal 40*a* detected by the current detecting circuit 40 with a current value set in accordance with the overexciting current selecting signal 24*c* and the holding current selecting signal 24*d*. A control circuit 39 then controls the switching devices 33 and 34 according to the results of this comparison.

A circulating current element 38 circulates current flowing through the fuel injection valve 13 back thereto after letting the current flow through the following elements in this order: switching device 36 (or 37)→current detecting circuit 40→ground→circulating current element 38.

FIG. 3 shows a configuration, in which the switching devices 33 and 34, the current reverse flow preventive device 35, the circulating current element 38, and the current detecting circuit 40 are provided for each of the fuel injection valves 13 corresponding to cylinders. In actual applications, it is possible to provide the switching devices 33 and 34, the current reverse flow preventive device 35, the circulating current element 38, and the current detecting circuit 40 independently for each of the fuel injection valves 13.

The control circuit 39 controls the switching devices 33, 34, 36, and 37.

The CPU 24 outputs fuel injection pulse signals 24*a* and 24*b* based on a fuel injection pulse width calculated therein and supplies the output to the control circuit 39.

There are two methods available for controlling the overexciting current 33*a* for opening the fuel injection valve. One is to control the value of the overexciting current 33*a* by directly monitoring the current value. The other is to control the turn-on time of the overexciting current. In case of controlling the turn-on time of the overexciting current, a pulse signal 24*g* for the overexciting is used.

Figure 4:
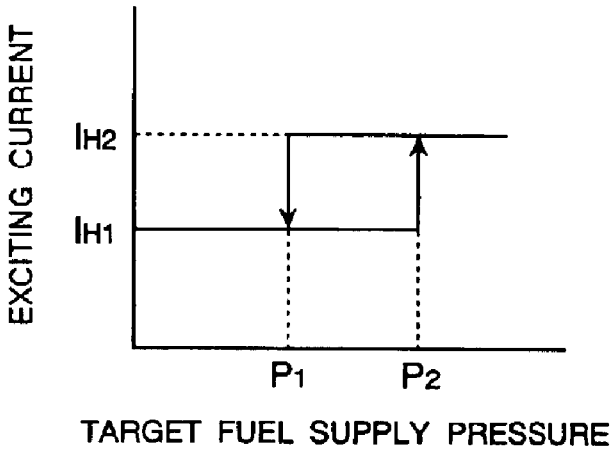
FIG. 4 is a diagram showing a typical relationship between a target fuel supply pressure and an overexciting current value.

FIG. 4 shows a typical relationship between the target fuel supply pressure and the overexciting current value. When the target fuel supply pressure becomes $P_2$ or higher, the overexciting current is set to $I_{H2}$. When the target fuel supply pressure becomes $P_1$ or lower, the overexciting current is set to $I_{H1}$. As is known from FIG. 4, there is provided a hysteresis of $P_2-P_1$ for the target fuel supply pressure to prevent the overexciting current from frequently alternating between $I_{H1}$ and $I_{H2}$.

Figure 5:
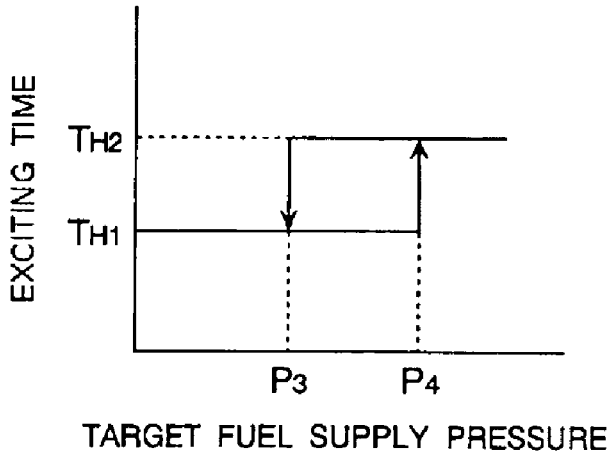
FIG. 5 is a diagram showing a typical relationship between the target fuel supply pressure and an overexciting time.

In the same manner as in FIG. 4, FIG. 5 shows a typical relationship between the target fuel supply pressure and the overexciting time (the turn-on time of the overexciting current).

The holding current 34*a* is controlled for keeping the fuel injection valve in the open position after overexciting was performed. As the control method of the holding current 34*a*, for example, two kinds of the holding current 34*a* is set up, and the time for selecting either of these two current values is controlled.

Figure 6:
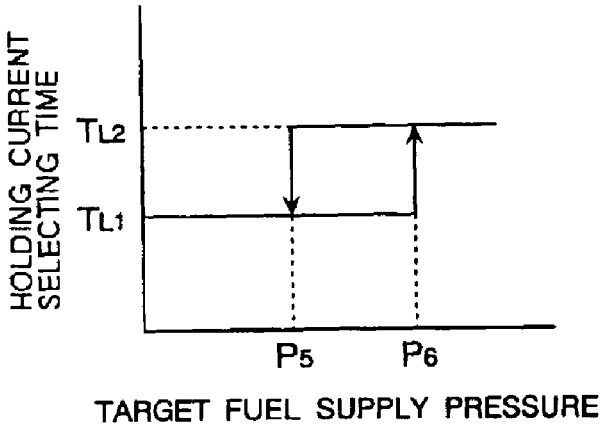
FIG. 6 is a diagram showing a typical relationship between the target fuel supply pressure and a holding current selecting time.

FIG. 6 shows a typical relationship between the target fuel supply pressure and the time period of the holding current.

Figure 7:
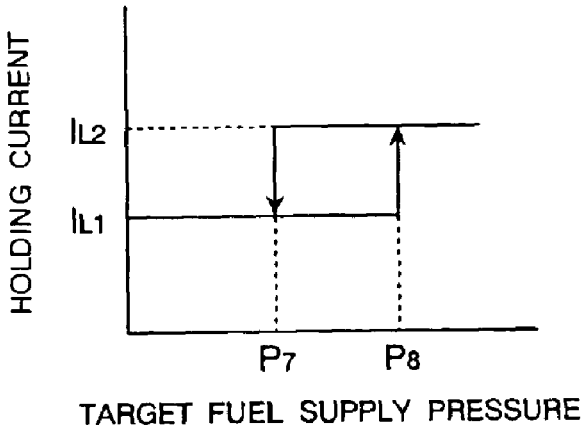
FIG. 7 is a diagram showing a typical relationship between the target fuel supply pressure and a holding current.

FIG. 7 shows a typical relationship between the target fuel supply pressure and the holding current values.

Figure 8:
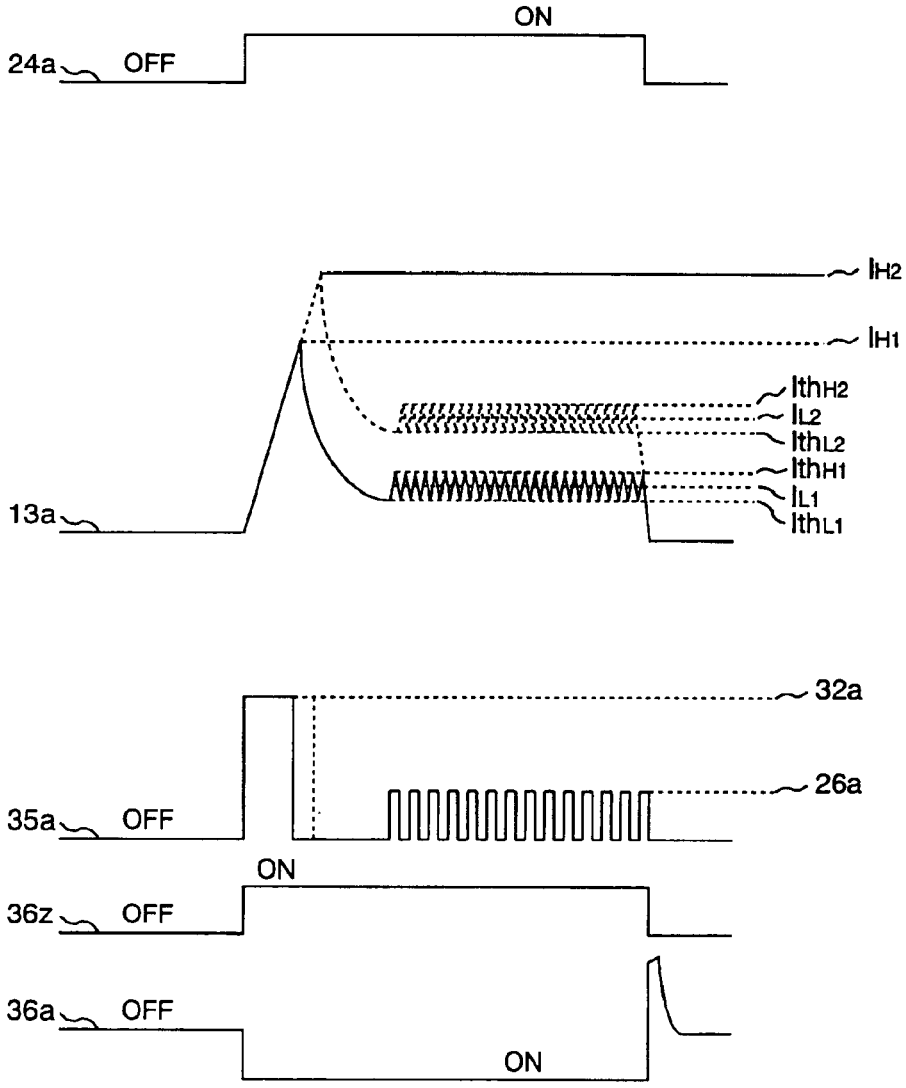
FIG. 8 is a diagram showing typical waveforms of a current when the overexciting current and the holding current are varied according to the target fuel supply pressure.

FIG. 8 shows waveforms of a current for driving the fuel injection valve when relationships of FIGS. 4 and 7 are used in combination with each other. The current waveforms shown in FIG. 8 represent a condition in case where $P_1$, $P_2$, $P_7$, and $P_8$, which are the target fuel supply pressure points for selecting either of the overexciting current values or for selecting either of the holding current values or for selecting either of the holding current values, are $P_1=P_7$ and $P_2=P_8$. The diagram shown in FIG. 8 will be explained together with operations of the circuit shown in FIG. 3. The CPU 24 sets the overexciting current value and the holding current value obtained from the target fuel supply pressure in the current control circuit 41 by using the overexciting current selecting signal 24*c* and the holding current selecting signal 24*d*, respectively. The current control circuit sets an overexciting current value $I_{H1}$ and slice levels $I_{thL1}$, $I_{thH1}$ so as to allow an average holding current value to become $I_{L1}$. The fuel injection pulse signal 24*a* from the CPU 24 is used to turn ON the switching device 33 on a voltage step-up side, thereby applying the stepped-up voltage 32*a* to the fuel injection valve 13. At the same time, the switching device 36 on a downstream side is also turned ON. During this time, the current detecting circuit 40 monitors a current flowing through the fuel injection valve 13. When the current 13*a* reaches $I_{H1}$, the switching device 33 on the voltage step-up side is turned OFF. The current 13*a* flowing through the fuel injection valve 13 is circulated through a path of the fuel injection valve 13→the switching device 36 on the downstream side→the current detecting circuit 40→the circulating device 38 until the current 13*a* is decreased to $I_{thL1}$. When the current 13*a* is decreased to $I_{thL1}$, the switching device 34 on a battery side is turned ON to apply the battery voltage 26*a* to the fuel injection valve 13. When the current 13*a* is increased to $I_{thH1}$, the switching device 34 on the battery side is turned OFF. The current 13*a* is then circulated through a path of the fuel injection valve 13→the switching device 36 on the downstream side→the current detecting circuit 40→the circulating device 38 until the current 13*a* is decreased to $I_{thL1}$. The switching device 34 on the battery side is thereafter repeatedly turned OFF and ON in the same manner so as to bring the average current to $I_{L1}$. In synchronism with the fuel injection pulse signal 24*a* turning OFF, the switching devices 33 and 34 on the upstream side and the switching device 36 on the downstream side are turned OFF to shut down the supply of current to the fuel injection valve 13. The foregoing description is concerned with the operation of the switching device 36 on the downstream side. It goes without saying that the same operation applies to the switching device 37. Likewise, the foregoing description is concerned with the operation of $I_{H1}$ and $I_{L1}$, and the explanation of the operation of $I_{H2}$ and $I_{L2}$, which is the same as that of $I_{H1}$ and $I_{L1}$, will be omitted.

Figure 9:
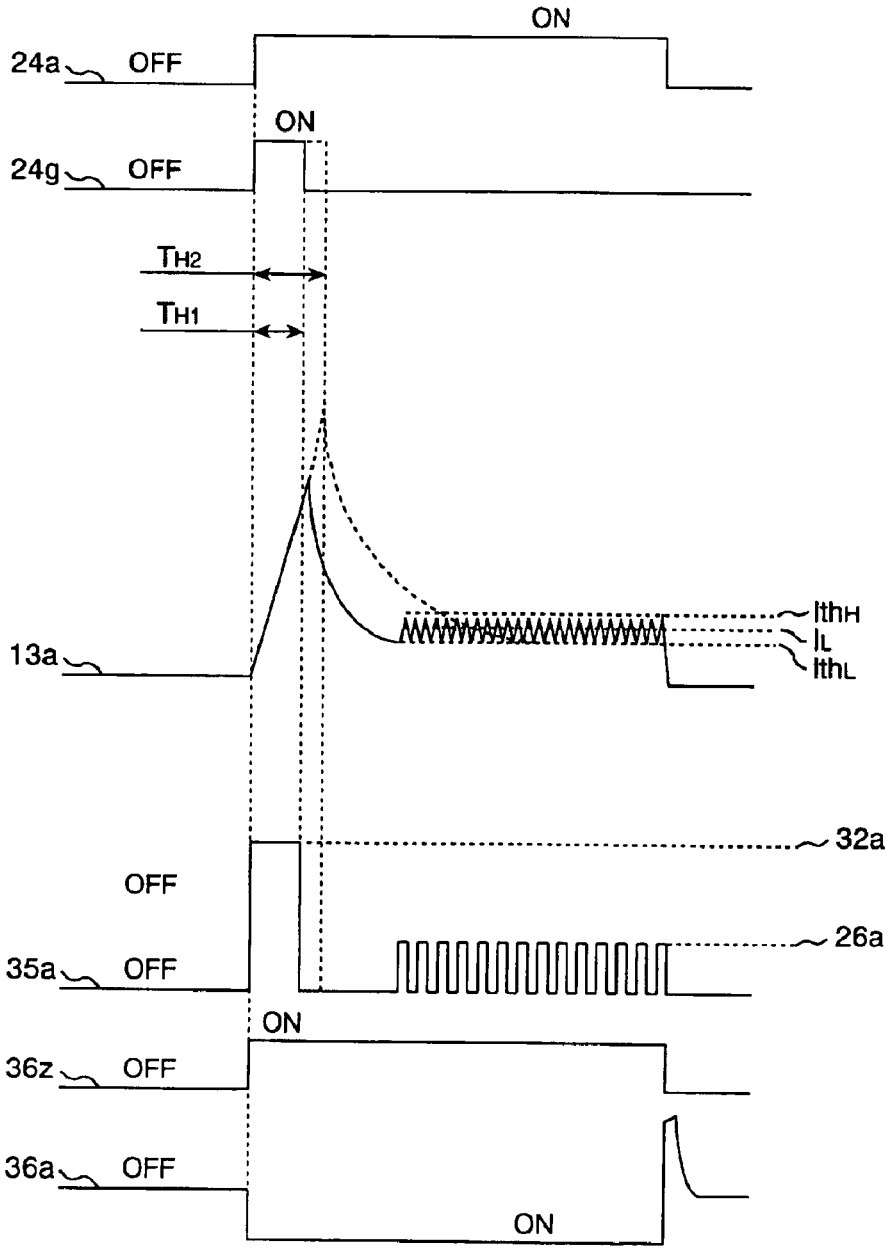
FIG. 9 is a diagram showing typical waveforms of a current when the overexciting time is varied according to the target fuel supply pressure.

FIG. 9 shows waveforms of a current for driving the fuel injection valve when the overexciting time of FIG. 5 is used.

In the example shown in FIG. 9, the fuel injection valve 13 is driven in accordance with the overexciting time as obtained from the target fuel supply pressure. The diagram shown in FIG. 9 will be explained together with operations of the circuit shown in FIG. 3. The CPU 24 outputs an overexciting pulse signal 24*g* of an overexciting time $T_{H1}$ as obtained from the target fuel supply pressure to the current control circuit. Slice levels $I_{thL}$ and $I_{thH}$ that allow the average holding current value to become $I_L$ have previously been set in the current control circuit. While a logical product of the fuel injection pulse signal 24*a* from the CPU 24 and the overexciting pulse is materialized, the switching device 33 on the voltage step-up side is turned ON to apply the stepped-up voltage 32*a* to the fuel injection valve 13. At the same time, the switching device 36 on the downstream side is also turned ON. When the logical product is not materialized after the lapse of the overexciting time $T_{H1}$, the switching device 33 on the voltage step-up side is turned OFF. The current detecting circuit 40 monitors the current 13*a* that flows through the fuel injection valve 13. The current 13*a* is circulated through a path of the fuel injection valve 13→the switching device 36 on the downstream side→the current detecting circuit 40→the circulating current device 38 until the current 13*a* is decreased to $I_{thL}$. When the current 13*a* is decreased to $I_{thL}$, the switching device 34 on the battery side is turned ON to apply the power source voltage 26*a* to the fuel injection valve 13. The subsequent operations, which follow the same procedure as explained for FIG. 8, will be omitted.

Figure 10:
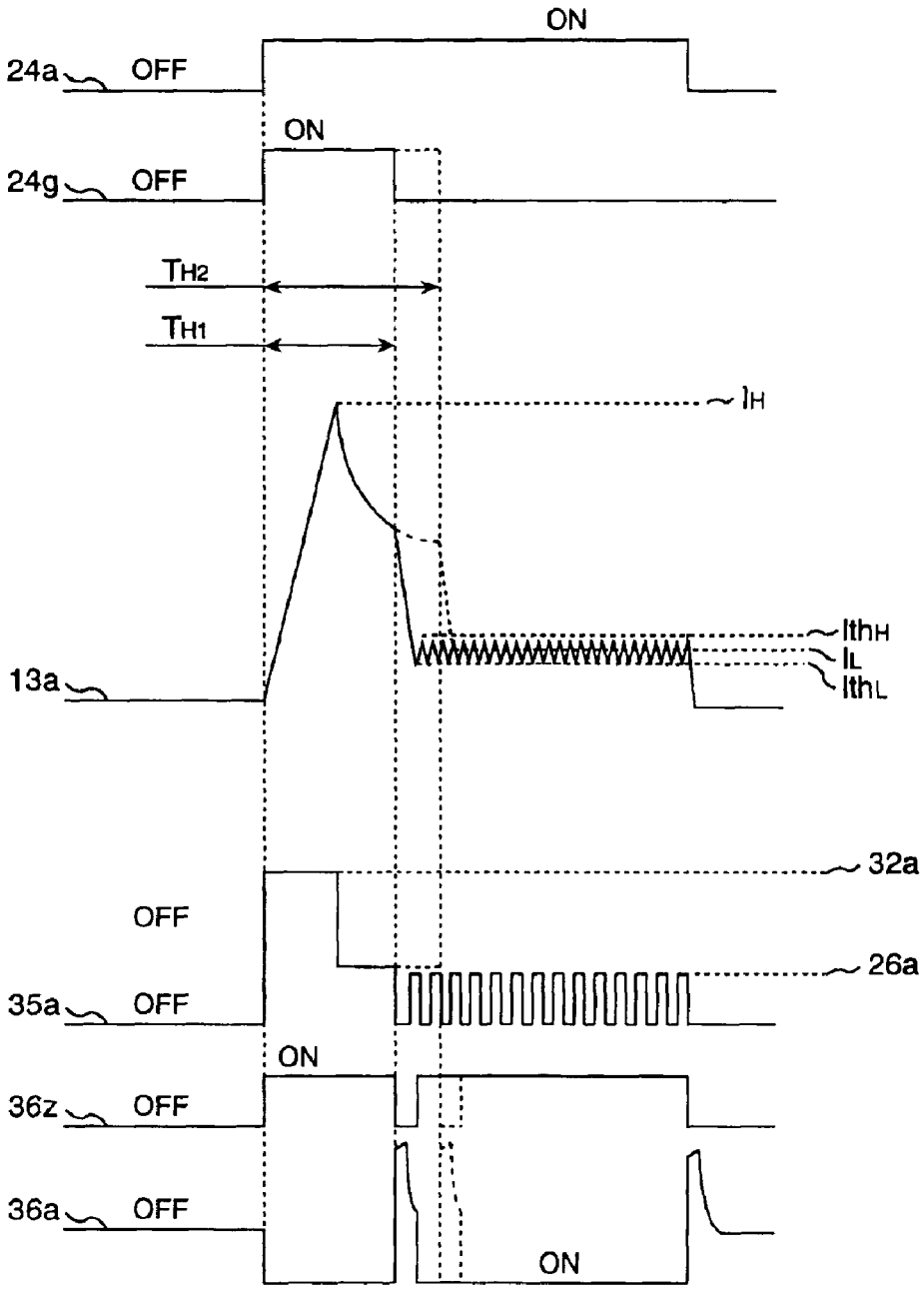
FIG. 10 is a diagram showing typical waveforms of a current when the overexciting time expires when the holding current is reached, as against the case shown in FIG. 9.

FIG. 10 shows, as with FIG. 9, waveforms of a current for driving the fuel injection valve when FIG. 5 cited earlier is used.

B In the example shown FIG. 10, the time until the current changes to the holding current after the fuel injection valve was energized is assumed as the time period of the overexciting time. The diagram shown in FIG. 10 will be explained together with operations of the circuit shown in FIG. 2. The CPU 24 outputs of the overexciting pulse signal 24*g* of the overexciting time $T_{H1}$ as obtained from the target fuel supply pressure to the current control circuit 41. An overexciting current $I_H$ and slice levels $I_{thL}$, $I_{thH}$ that allow the average holding current value to become $I_L$ have previously been set in the current control circuit 41. The switching device 33 on the voltage step-up side is turned ON by the fuel injection pulse signal 24*a* from the CPU 24. In addition, while a logical product of the fuel injection pulse signal 24*a* and the overexciting pulse signal 24*g* is materialized, the switching device 34 on the battery side is also turned ON. Though both the switching device 33 on the voltage step-up side and the switching device 34 on the battery side are ON at this time, the stepped-up voltage 32*a* is energized to the fuel injection valve 13 because of the relationship that the stepped-up voltage 32*a* is greater than the battery voltage 26*a*. At the same time, the switching device 36 on the downstream side is also turned ON. During this period, the current detecting circuit 40 monitors the current 13*a* that flows through the fuel injection valve 13. When the current value increases to $I_H$, the switching device 33 on the voltage step-up side is turned OFF. Since the logical product still remains true at this time, the switching device 34 on the battery side keeps ON. At this time, the current 13*a* flowing through the fuel injection valve 13 decreases slowly, while being circulated through a path of the fuel injection valve 13→the switching device 36 on the downstream side→the current detecting circuit 40→the circulating device 38. When the logical product changes into non-materialization after the lapse of the overexciting time $T_{H1}$, both the switching device 34 on the battery side and the switching device 36 on the downstream side are turned OFF, thus shutting off the current 13*a* flowing through the fuel injection valve 13. If the current 13*a* is sharply decreased down to $I_{thL}$ at this time, both the switching device 34 on the battery side and the switching device 36 on the downstream side are turned ON again to apply the battery voltage 26*a* to the fuel injection valve 13. When the current 13*a* increases to $I_{thH}$, the switching device 34 on the battery side is turned OFF. The subsequent operations, which follow the same procedure as explained for FIG. 8, will be omitted.

Figure 11:
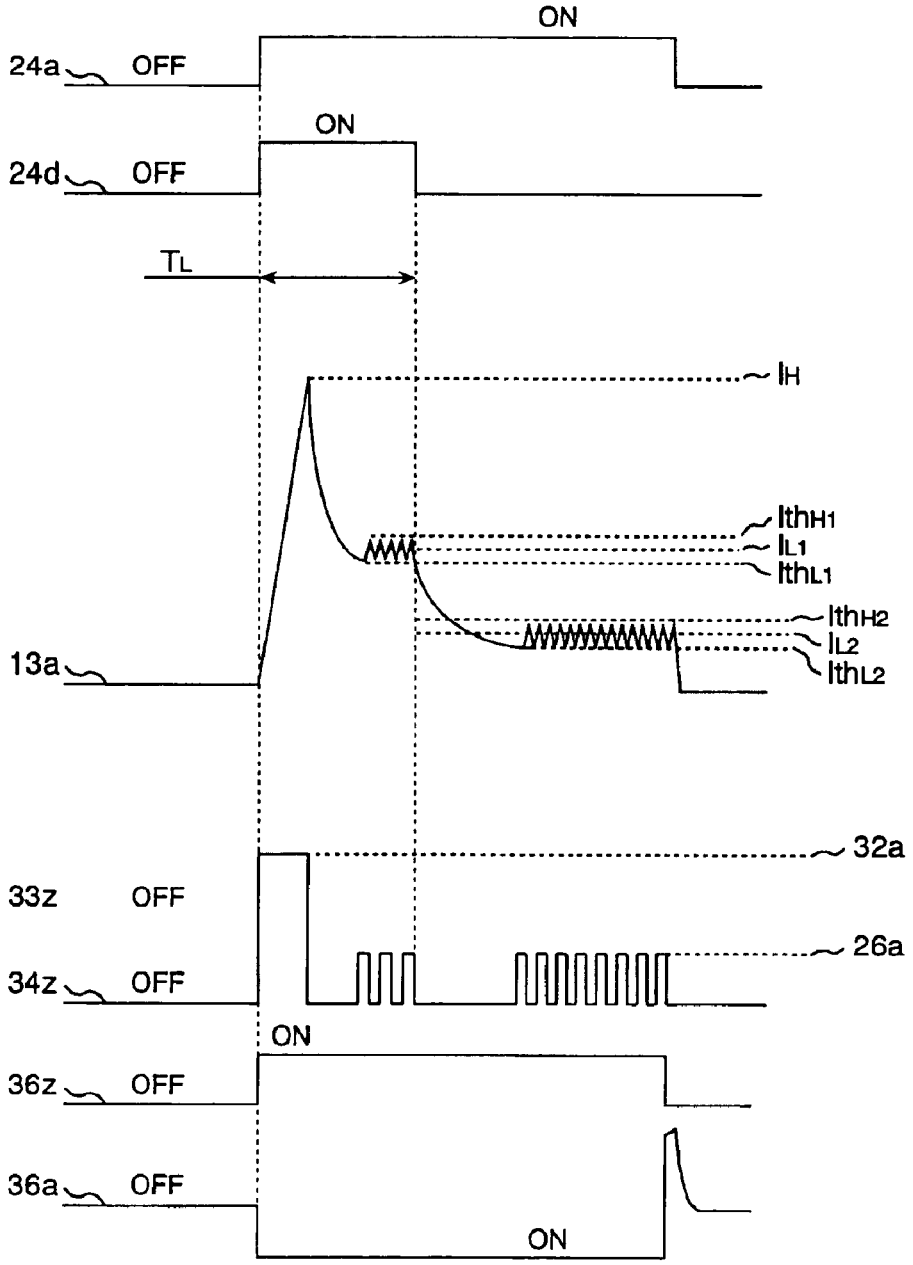
FIG. 11 is a diagram showing typical waveforms of a current when the holding current selecting time is varied according to the target fuel supply pressure.

FIG. 11 shows waveforms of a current for driving the fuel injection valve when FIG. 6 cited earlier is used.

In the example shown in FIG. 11, the holding current is varied in two steps and the applicable holding current is selected according to a holding current selecting time as obtained from the target fuel supply pressure. The diagram shown in FIG. 11 will be explained together with operations of the circuit shown in FIG. 3. An output of a holding current selecting pulse signal 24*d* of a holding current selecting time $T_L$ as obtained from the target fuel supply pressure by the CPU 24 is provided for the current control circuit. The overexciting current $I_H$, slice levels $I_{thL1}$ and $I_{thH1}$ that allow a first average holding current value to become a holding current value $I_{L1}$, and slice levels $I_{thL2}$ and $I_{thH2}$ that allow a second average holding current value to become a holding current value $I_{L2}$ have previously been set in the current control circuit. The switching device 33 on the voltage step-up side is turned ON by the fuel injection pulse signal 24*a* from the CPU 24, thereby applying the stepped-up voltage 32*a* to the fuel injection valve 13. At the same time, the switching device 36 on the downstream side is also turned ON. During this period, the current detecting circuit 40 monitors the current 13*a* that flows through the fuel injection valve 13. When the current value increases to $I_H$, the switching device 33 on the voltage step-up side is turned OFF. The current 13*a* is circulated through a path of the fuel injection valve 13→the switching device 36 on the downstream side→the current detecting circuit 40→the circulating current device 38 until the current 13*a* is decreased to $I_{thL1}$. When the current 13*a* is decreased to $I_{thL1}$, the switching device 34 on the battery side is turned ON to apply the battery voltage 26*a* to the fuel injection valve 13. When the current 13*a* increases to $I_{thH1}$, the switching device 34 on the battery side is turned OFF. These switching operations are carried out as long as the logical product of the fuel injection pulse signal 24*a* and the holding current selecting pulse signal 24*d* remains true. When the logical product is not true after the lapse of the holding current selecting time $T_L$, the switching device 34 on the battery side is turned OFF. Then, the current 13*a* is circulated through a path of the fuel injection valve 13 the switching device 36 on the downstream side→the current detecting circuit 40→the circulating device 38 until the current 13*a* decreases to $I_{thL2}$. When the current 13*a* decreases to $I_{thL2}$, the switching device 34 on the battery side is turned ON again to apply the battery voltage 26*a* to the fuel injection valve 13. When the current 13*a* increases to $I_{thH2}$, the switching device 34 on the battery side is turned OFF. The subsequent operations, which follow the same procedure as explained for FIG. 8, will be omitted.

A number of patterns are conceivable for the combination of control of overexciting and holding and no more will be described. It is nonetheless important that an optimum combination of overexciting and holding control be selected in consideration of characteristics of the fuel injection valve 13, the dynamic range of the amount of fuel injection, operating conditions, and the like.

According to the preferred embodiments of the present invention, it is possible to provide a system and a method for opening a fuel injection valve, while keeping as small as possible a detection lag of a fuel supply pressure.

What is claimed is:

1. A fuel injection system, comprising:

a fuel pressurizing unit for pressurizing fuel;

a fuel supply pressure monitoring unit for detecting a supply pressure of said fuel;

an operating condition detecting unit for detecting an operating condition of an engine;

a control device for calculating a target fuel supply pressure based on said detected operating condition and controlling said fuel pressurizing unit so as to bring said supply pressure to said target fuel supply pressure; and a fuel injection valve opening when an overexciting current is supplied thereto and keeping an open position while holding current is supplied thereto, wherein the overexciting current and the holding current supplied to said fuel injection valve are varied according to said target fuel supply pressure, thereby ensuring that fuel, the pressure of which has been controlled to said target fuel supply pressure, is supplied to and injected through said fuel injection valve.

2. The fuel injection system according to claim 1, wherein an overexciting time for supplying said overexciting current to said fuel injection valve is set up to be variable.

3. The fuel injection system according to claim 1, wherein the holding current supplied to said fuel injection valve comprises at least two different holding current values.

4. The fuel injection system according to claim 1, further comprising a step-up circuit for stepping-up a voltage to a level greater than a battery voltage, wherein said voltage stepped-up to a level greater than said battery voltage is applied to supply said fuel injection valve with said exciting current.

5. The fuel injection system according to claim 1, wherein said operating condition includes at least engine speed information and the target fuel supply pressure is calculated based on said information.

6. The fuel injection system according to claim 1, wherein said operating condition includes at least accelerator pedal opening information and the target fuel supply pressure is calculated based on said information.

7. The fuel injection system according to claim 1, wherein said operating condition includes at least intake air flow rate information and the target fuel supply pressure is calculated based on said information.

8. A fuel injection control device for controlling a fuel pressurizing unit so that a target fuel supply pressure calculated based on an engine operating condition becomes a supply pressure of fuel, wherein:

an overexciting current and a holding current, which are supplied to a fuel injection valve that opens when the overexciting current is supplied thereto and keeps an open position while the holding current is supplied thereto, are varied in accordance with said target fuel supply pressure, thereby supplying said fuel to and injecting said fuel through said fuel injection valve.

9. The fuel injection control device according to claim 8, wherein an overexciting time for supplying said overexciting current to said fuel injection valve is set up to be variable.

10. The fuel injection control device according to claim 8, wherein the holding current supplied to said fuel injection valve comprises at least two different holding current values.

11. The fuel injection control device according to claim 8, further comprising a step-up circuit for stepping-up a voltage to a level greater than a battery voltage, wherein said voltage stepped-up to a level greater than said battery voltage is applied to supply said fuel injection valve with said exciting current.

12. The fuel injection control device according to claim 8, wherein said operating condition includes at least engine speed information and the target fuel supply pressure is calculated based on said information.

13. The fuel injection control device according to claim 8, wherein said operating condition includes at least accelerator pedal opening information and the target fuel supply pressure is calculated based on said information.

14. The fuel injection control device according to claim 8, wherein said operating condition includes at least intake air flow rate information and the target fuel supply pressure is calculated based on said information.

15. A fuel injection control method for controlling pressurization of fuel, comprising the steps of:

detecting a supply pressure of fuel;

detecting an engine operating condition;

calculating a target fuel supply pressure from said detected operating condition; and bringing said supply pressure of fuel to said target fuel supply pressure, wherein an overexciting current and a holding current supplied to said fuel injection valve are varied in accordance with said target fuel supply pressure, said fuel injection valve is opened when said overexciting current is supplied thereto, said fuel injection valve is held in an open position while said holding current is supplied thereto, fuel having said target fuel supply pressure is supplied to said fuel injection valve, and said fuel is injected.

* * * * *